US009056341B2

(12) United States Patent
Kümmerling et al.

(10) Patent No.: US 9,056,341 B2
(45) Date of Patent: Jun. 16, 2015

(54) METHOD FOR PRODUCING SEAMLESS TUBES BY MEANS OF A THREE-ROLL BAR ROLLING MILL

(75) Inventors: Rolf Kümmerling, Duisburg (DE); Manfred Bellmann, Ratingen (DE); Winfried Braun, Düsseldorf (DE); Hidenori Kinugasa, Wakayama (JP); Sasaki Kenichi, Wakayama (JP)

(73) Assignee: V & M DEUTSCHLAND GmbH, Düsseldorf (DE)

( * ) Notice: Subject to any disclaimer, the term of this patent is extended or adjusted under 35 U.S.C. 154(b) by 917 days.

(21) Appl. No.: 13/133,518

(22) PCT Filed: Nov. 20, 2009

(86) PCT No.: PCT/DE2009/001685

§ 371 (c)(1), (2), (4) Date: Aug. 19, 2011

(87) PCT Pub. No.: WO2010/066230

PCT Pub. Date: Jun. 17, 2010

(65) Prior Publication Data

US 2012/0125068 A1 May 24, 2012

(30) Foreign Application Priority Data

Dec. 9, 2008 (DE) ..... 10 2008 061 141

(51) Int. Cl.

| | |
|---|---|
| ***B21B 27/02*** | (2006.01) |
| ***B21B 23/00*** | (2006.01) |
| *B21B 17/04* | (2006.01) |
| *B21B 17/14* | (2006.01) |

(52) U.S. Cl.

CPC ..... *B21B 27/024* (2013.01); *B21B 17/04* (2013.01); *B21B 17/14* (2013.01); *B21B 23/00* (2013.01)

(58) Field of Classification Search

CPC ..... B21B 17/02; B21B 17/04; B21B 17/14; B21B 23/00; B21B 27/024; B21B 27/025

USPC ..... 72/95–100, 252.5

See application file for complete search history.

(56) References Cited

U.S. PATENT DOCUMENTS 5,109,689 A * 5/1992 D'Avanzo ..... 72/97
7,174,761 B2 * 2/2007 Iwamoto et al. ..... 72/235

FOREIGN PATENT DOCUMENTS

EP 1 707 281 A1 10/2006
EP 1 889 669 A1 2/2008

OTHER PUBLICATIONS

"Stahlrohr Handbuch" ["*steel tube handbook*"], Publisher: Vulkan-Verlag, Essen, 12. Edition, 1995, pp. 107-111.

*Primary Examiner* — Debra Sullivan

(74) *Attorney, Agent, or Firm* — Henry M. Feiereisen LLC

(57) ABSTRACT

The invention relates to a method for producing seamless tubes from metal, particularly from steel, wherein a previously produced hot hollow block is stretched by means of a three-roll bar rolling mill on a mandrel to form a parent tube and, before running into the bar rolling mill, the hollow block is provided with a rolling step that makes the diameter more uniform by means of an upstream stand. It is in this case provided that the rolls of the upstream stand are moved apart and together to the same extent as the deforming stands of the bar rolling mill, wherein the calibrating base radius of the rolls of the upstream stand extends over 60° and this is followed by a flank radius with a tangential transition which is dimensioned such that even with the maximum setting of the rolls in the region of the flank there is virtually no diameter reduction of the largest hollow block diameter to be expected.

5 Claims, 2 Drawing Sheets

Cross-section parallel to the rolling direction

METHOD FOR PRODUCING SEAMLESS TUBES BY MEANS OF A THREE-ROLL BAR ROLLING MILL

CROSS-REFERENCES TO RELATED APPLICATIONS

This application is the U.S. National Stage of International Application No. PCT/DE2009/001685, filed Nov. 20, 2009, which designated the United States and has been published as International Publication No. WO 2010/066230 and which claims the priority of German Patent Application, Serial No. 10 2008 061 141.7, filed Dec. 9, 2008, pursuant to 35 U.S.C. 119(a)-(d).

BACKGROUND OF THE INVENTION

The invention relates to a method for producing seamless tubes with a three-roll bar rolling mill.

A generic method is described in the steel tube handbook (Publisher: Vulkan-Verlag, Essen, 12. Edition, 1995, p. 107-111).

Bar rolling mills which operate, for example, according to the continuous tube rolling process, are used in the production of seamless tubes. They are used to stretch a hollow block that was produced earlier by transverse rolling into a parent tube. This parent tube is subsequently reduced in a sizing or stretch-reducing mill to the desired final dimensions.

Basically, bar rolling mills exist in two embodiments, with two or three rolls per stand. The number of stands typically varies between four and eight.

It is known that a bar rolling mills are very sensitive to variations of the wall thickness and the diameter of the incoming hollow blocks. However, such variations cannot always be prevented in a transverse rolling process which is typically used to produce the hollow block.

In particular, transverse rolling mills with Diescher disks as a guide means produce hollow blocks with diameters that deviate in the head and foot region from the "filet region." in the bar rolling process, these deviations can result in caliber underfills, wall thickness constrictions, holes and caliber overfills.

To minimize these errors, it is also known to arrange a hollow block reduction stand (void reduction stand) upstream of the bar rolling process. Such stand has four rolls in a two-roll bar rolling mill, and three rolls in a three-roll bar rolling mill.

Disadvantageously, in conventional hollow block reduction stands, the rolling conditions in the bar rolling mill still change with different diameters of the hollow blocks.

As a result, different input conditions are produced for the bar rolling mill during the deformation (input play hollow block to bar, reduction of the outside diameter in the first stand), which may again have negative effects for the quality of the tube.

It is an object of the present invention to define the a calibration and travel of the void reduction stand (VRS) for a three-roll bar rolling mill such that almost identical rolling conditions for the deformation in the bar rolling mill are retained even when the hollow block has different diameters.

It is hereby the goal to equalize as much as possible the diameter deviations in the hollow block as well as from one hollow block to another hollow block while simultaneously preventing underfilling or overfilling of the caliber.

SUMMARY OF THE INVENTION

According to the teaching of the invention, the object is attained by a method, wherein the rolls of the upstream stand are moved opened and closed to the same degree as the deformation stands of the bar rolling mill, whereby the basic calibration radius of the rolls of the upstream stand extends over 60°, followed by a flank radius with tangential transition, which is dimensioned such that also at maximum closure of the rolls almost no reduction in diameter of the largest expected hollow block diameter occurs in the region of the flank.

The present invention has the significant advantage that with the proposed methods and the corresponding calibration, on one hand, the range of variation of the diameter of the hollow block entering the bar rolling mill can be significantly reduced and, on the other hand, the calibration according to the invention makes it possible to set almost identical conditions for the bar rolls even for different diameters of the hollow block tube, which results in a much more uniform quality in the geometry of the tube.

In an advantageous embodiment of the invention, the setting of the upstream stand is adjusted commensurate with the setting of the first stand of the bar rolling mill such that the absolute value of the average play relative to the bar remains constant for the setting range of the first stand.

A constant bar play at the output of the void reduction stand results in uniform deformation conditions during the rolling process and hence to a significantly improved quality of the tube.

According to another advantageous embodiment of the invention, for a predetermined bar diameter, all stands of the bar rolling mill downstream of the bar rolling mill can be adjusted by the same amount for attaining the desired wall thickness, wherein this amount also corresponds to the setting of the upstream stand.

Unlike with constant input play, this approach does not require complicated computations for changing the setting. This has the additional advantage that no overfilling or under filling of the caliber can occur for the bar rolling mill, i.e., the input conditions in relation to the outside diameter for the rolling in the bar rolling mill are almost constant.

According to additional advantageous features of the invention, only the absolute value of the setting of the upstream stand corresponds to the setting of the first stand of the bar rolling mill. The cooperation of the void reduction stand and the subsequent first working stand is important for the quality of the rolling process. Alternatively, the relative value of the setting of the upstream stand may also correspond to the setting of the first stand of the bar rolling mill.

Advantageously, using the relative value of the setting then also takes into consideration wear (wear compensation) in addition to the almost constant input conditions for the bar rolling mill, thereby improving the service life.

In another advantageous embodiment of the invention, the caliber base radius has an eccentricity which is dimensioned so as to become zero during maximum opening of the upstream stand.

Advantageously, the thereby formed contact surface roll-rolling stock positively affects the roll wear at the caliber discontinuity. In addition, this has the positive effect of reducing flaws on the outside surface, such as for example caliber stripes.

BRIEF DESCRIPTION OF THE DRAWING

Additional features, advantages and details of the invention can be inferred from the following description of an exemplary embodiment illustrated in a drawing.

DETAILED DESCRIPTION OF PREFERRED EMBODIMENTS

Reduction stands according to the state-of-the-art are typically calibrated ovally. To this end, a caliber base radius AI is defined which continuously increases to a caliber flank radius BI.

Figure 1A:
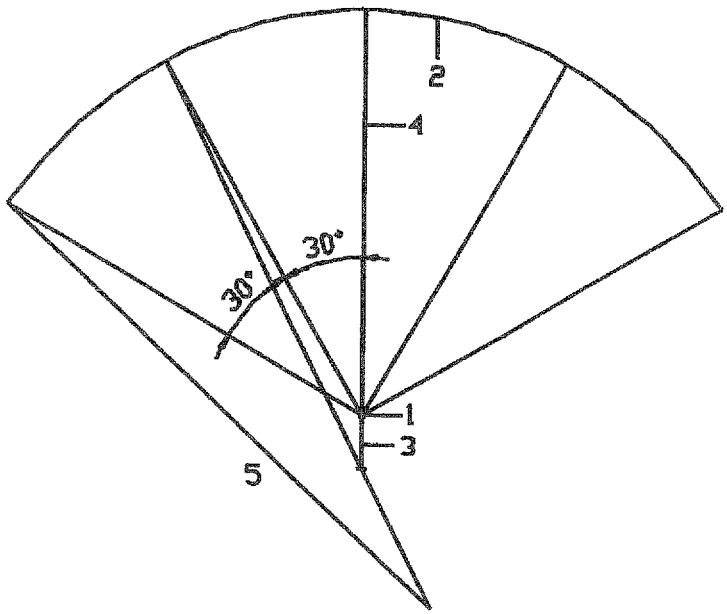
FIG. 1*a* shows a round calibration of a tube according to the invention.

Conversely, according to the invention, a round calibration is proposed wherein a basic radius R1 transitions over an angular length of 60° tangentially into a flank radius having a working range of 30° for each flank (FIG. 1*a*). Also shown in FIG. 1*a* is the roll axis (1), the caliber contour (2), the eccentricity (3) of the caliber base radius R1, the caliber base radius R1 (4) as well as the caliber flank radius R2 (5).

With this calibration, the variation of the hollow block diameter exiting the void reduction stand (VRS) can advantageously be cut in half relative to the oval calibration.

This will now be described with reference to the following example. In this example, the quantity BI is used for the distance between roll axis and caliber ground and the quantity AI for the distance between roll axis and caliber flank.

The outside diameters of the hollow blocks generated by the transverse rolling mill have generally a tolerance of, for example, 2.5%.

The VRS should be able to accept at the caliber discontinuity the maximum hollow block diameter×0.99 to 1.00 (2×AI). The diameter of the caliber center (2×BI) should correspond to the minimum hollow block diameter×0.99 to 1.00.

The two calibration methods produce the following results:

Oval Calibration

Radius with BI at the caliber center and continuous increase to AI at the gauge discontinuity. The resulting average caliber diameter is 2×(BI+(AI−BI)/2).

Round Calibration

Radius with BI at the caliber center over 60° (±30°) and continuous increase to AI at the caliber discontinuity (each 30°). The average caliber diameter is in good approximation 2×(BI+(AI−BI)/4).

EXAMPLE

| | |
|---|---|
| Hollow block diameter maximally | 102.50 mm |
| Hollow block diameter average | 100.00 mm |
| Hollow block diameter minimally | 97.50 mm |
| Input tolerance maximally | 5.00 mm |

Oval Calibration

| | |
|---|---|
| AI = 1.00 × hollow block diameter max./2 | 51.25 mm |
| BI = 1.00 × hollow block diameter min./2 | 48.75 mm |
| VRS diameter min. = 2 × BI | 97.50 mm |
| VRS diameter max. = 2 × (48.75 + (51.25 − 48.75)/2) | 100.00 mm |

Accordingly, a hollow block with a diameter 100 mm leaves the VRS with 100 mm. A smaller diameter retains its size.

The output tolerance is maximally 2.5%.

Round Calibration

| | |
|---|---|
| AI = 1.00 × hollow block diameter max. | 51.25 mm |
| BI = 1.00 × hollow block diameter min./2 | 48.75 mm |
| VRS diameter min. = 2 × BI | 97.50 mm |
| VRS diameter max. = 2 × (48.75 + (51.25 − 48.75)/4) | 98.75 mm |

Accordingly, a hollow block with a diameter ≥98.75 mm leaves the VRS with 98.75 mm. A smaller diameter retains its size.

The output tolerance is maximally 1.25% (in relation to the nominal hollow block diameter).

With oval calibration, the tolerance is improved from 5 to 2.5% (50%), whereas the tolerance is improved from 5 to 1.25% (75%) with a round calibration.

Different wall thicknesses are rolled on the same rolling bar. To this end, the working stands must be opened and closed. The VRS should approximately follow this opening and closing motion, because only then remains the cooperation of VRS with the working stands approximately unchanged.

Figure 1B:
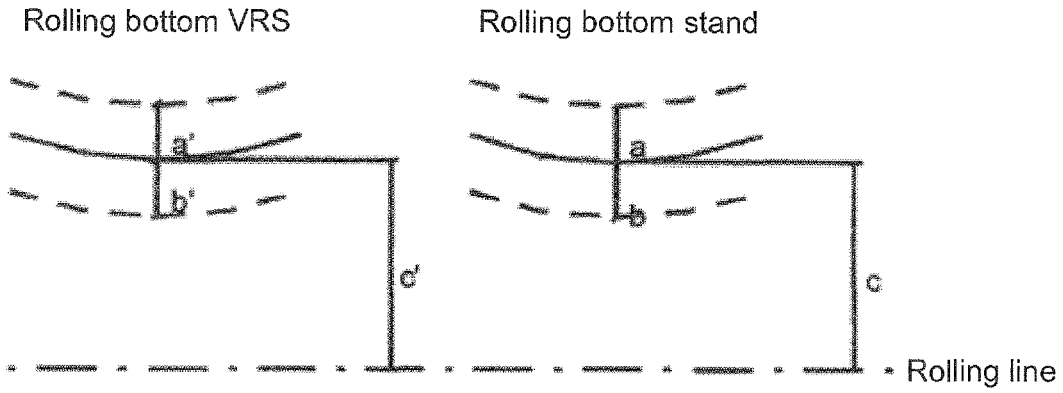
FIG. 1*b* shows a void reduction stand (left side) and a first stand of the bar rolling mill (right side).

FIG. 1*b* shows the VRS stand (on the left side) and the first stand of the bar rolling mill (on the right side). c and c' correspond to the nominal setting of the VRS stand and first stand of the three-roll bar rolling mill, wherein c' is the open-dimension of the caliber of the VRS and c is the open-dimension of the caliber of the bar rolling mill in the nominal setting.

a and a' indicate the positive change in the setting (opening) of the bar rolling mill and the VRS stand.

b and b' indicate the negative change in the setting (closing) of the bar rolling mill and the VRS stand.

Calculation

"Absolutely Identical":

The travel (positive=opening, negative=closing) of first stands of the bar rolling mill and of the VRS stand have the same absolute value (a'=a and b'=b).

"Relatively Identical":

The travel (positive=opening, negative=closing) of the VRS stand to the first stand of the bar rolling mill is relatively identical, i.e., it is a function of the nominal position (c, c') and the travel of the first rolling stand (a, b).

"Absolutely identical":

$$b \geq a$$

$$a' = a$$

$$b' = b$$

or

"Relatively Identical":

$$\frac{a+c}{c} = \frac{a'+c'}{c'}$$

$$a' = \left(\frac{a+c}{c}\right) \cdot c' - c'$$

and $$b' = \left(\frac{c-b}{c}\right) \cdot c' - c'$$

e.g.

$$c = 100 \text{ mm}; a = 1 \text{ mm}; c' = 88 \text{ mm}$$

$$a' = \frac{(1+100)}{100} \cdot 88 - 88 = 0.88$$

The invention claimed is:

1. A method for producing seamless tubes from metal, in particular from steel, comprising the steps of:

heating a hollow block, rolling the hot hollow block in a rolling stand having rolls configured to be opened and closed so as to equalize a diameter of the hot hollow block, transporting the hot hollow block to a three-roll bar rolling mill arranged downstream of the rolling stand and having a plurality of deformation stands comprising rolls configured to be opened and closed, inserting a mandrel bar in the hot hollow block, reducing a wall thickness of the hot hollow block on the inserted mandrel bar in the three-roll bar rolling mill to form a parent tube, and opening and closing the rolls of the rolling stand in an amount that is identical to an amount by which the rolls of the plurality of deformation stands are opened and closed, wherein a caliber base radius of the rolls of the rolling stand extends over 60° and is followed by a flank radius with a tangential transition which is dimensioned such that for maximum closure of the rolls there is practically no reduction of the diameter of the hot hollow block in a region of the flanks for a maximally expected diameter of the hot hollow block.

2. The method of claim 1, wherein for a defined set of mandrel bars, all deformation stands of the bar rolling mill are opened and closed by an identical amount for attaining a desired wall thickness downstream of the bar rolling mill.

3. The method of claim 2, wherein a first stand of the plurality of deformation stands of the bar rolling mill is opened and closed by the same amount the rolls of the rolling stand are opened and closed.

4. The method of claim 3, wherein the rolling stand is opened and closed by the same amount the first stand of the plurality of deformation stands is opened and closed such that an absolute magnitude of an average play of the hot hollow block in relation to the mandrel bar remains constant for a range of opening and closing settings of the first stand.

5. The method of claim 1, wherein the caliber base radius has an eccentricity which is dimensioned such that it becomes equal to zero at a maximum opening of the rolls of the rolling stand.

* * * * *